United States Patent [19]

Lataix

[11] 4,067,440

[45] Jan. 10, 1978

[54] PACKAGING CONTAINER FOR THE EXTEMPORANEOUS PREPARATION OF MULTI-COMPONENT SOLUTIONS

[75] Inventor: Gilbert Lataix, Ste Menehould, France

[73] Assignee: Tuboplast France, Paris, France

[21] Appl. No.: 681,734

[22] Filed: Apr. 29, 1976

[30] Foreign Application Priority Data

May 21, 1975 France ..... 75.16549
Mar. 17, 1976 France ..... 76.08580

[51] Int. Cl.[2] ..... B65D 25/08
[52] U.S. Cl. ..... 206/222; 215/DIG. 8
[58] Field of Search ..... 206/219–222; 215/DIG. 8; 128/222

[56] References Cited

U.S. PATENT DOCUMENTS

| | | | |
|---|---|---|---|
| 2,721,552 | 10/1955 | Nosik | 215/DIG. 8 |
| 2,753,868 | 7/1956 | Seemar | 206/222 |
| 3,220,588 | 11/1965 | Lipari | 206/222 |
| 3,521,745 | 7/1970 | Schwartzman | 206/222 |
| 3,831,742 | 8/1974 | Gardella et al. | 206/219 |
| 3,858,738 | 1/1975 | Hurst | 215/DIG. 8 |

*Primary Examiner*—William T. Dixson, Jr.
*Assistant Examiner*—Douglas B. Farrow
*Attorney, Agent, or Firm*—Dennison, Dennison, Meserole & Pollack

[57] ABSTRACT

A multi-compartment container for mixing two or more constituents at the time of use formed by the assembly of a plurality of compartments which can be filled and assembled and sealed in sterile manner then placed in communication in an absolutely sterile manner by the action of a plunger inside the container while being able to be handled from the outside. Teeth on the plunger pierce the seals of the compartments.

8 Claims, 5 Drawing Figures

PACKAGING CONTAINER FOR THE EXTEMPORANEOUS PREPARATION OF MULTI-COMPONENT SOLUTIONS

The present invention relates to a packaging container for the extemporaneous preparation of multi-component solutions or mixtures. It concerns the packaging industry generally, and more particularly packages for products which must be stored separately and mixed only at the time of use. The use of such packages is developing rapidly in the chemical, cosmetic and pharmaceutical industries.

The pharmaceutical industry in particular quite often requires the extemporaneous production of solutions or mixtures of products stored in sterile conditions until the time of use without any risk of contamination.

Various packaging devices exist having two sterile compartments provided to facilitate the mixing of the constituents. Thus pairs of bottles are used being sealed by thin metal caps to obtain extemporaneous solutions of antibiotics. One of the bottles contains the liquid solvent, the other the antibiotic, generally in powder form. Using a syringe needle, the thin metal cap sealing the solvent is pierced, and the solvent is sucked into the syringe. Similarly, the cap sealing the bottle containing the antibiotic is pierced. The solvent is injected into the second bottle and the desired solution is obtained. But even if the syringe has been sterilized, the needle is in contact with the ambient atmosphere and with the external surfaces of the caps sealing the two bottles. Despite complicated and careful handling, the solution obtained is not absolutely sterile.

Pairs of bottles are known of which one is provided with a tapped ring into which the threaded neck of the other can be screwed; this second neck is provided with a pointed end designed to penetrate into the neck of the first bottle and to perforate the cap sealing it. But again the two bottles have to be opened in the air before screwing them into one another. Despite all the possible precautions there is the possibility of contamination.

Finally, a device is known for a bottle having a sufficiently wide neck so that a capped pot can be arranged in the inside of the neck while the bottle is surmounted by an end with a pusher trocar capable of perforating right through the capped pot and effecting communication between the two products. This device is largely described in French Pat. Nos. 2,129,079 and 2,169,445. However it is difficult to guarantee and maintain the sterility of the trocar outside the pot and the bottle. Ambient air will inevitably be introduced into the device at the moment when the guarantee bank immobilizing the trocar outside the bottle is removed.

The object of the present invention is therefore to produce a package storing the products separately in the sterile and inviolable sealed compartments, while permitting the homogeneous mixing of the products before use without any risk of contamination both as regards contact with the ambient air and with any instrument outside the package.

This result has been achieved by producing a packaging container separated into at least two compartments by at least one cap, while at least one of the compartments contains a plunger which can be operated from the outside and is capable of perforating the separation cap and in this way to place the two compartments in communication.

In a preferred embodiment, the compartment of the container in which the plunger is located is constructed from flexible material in such a way that the plunger can be operated by simple external pressure through the flexible wall of the compartment.

In a particular embodiment, the container is constituted by the assembly of at least two compartments, produced separately and each being sealed by a cap of substantially the same dimension. These containers can be filled separately under aseptic and sterile conditions before being sealed by their caps. They are then assembled by bringing the caps opposite one another so that the plunger perforates the caps almost simultaneously when activated.

After perforation of the cap or caps the components can mix and it is sufficient to shake the container vigorously to obtain a homogeneous mixture or solution before opening the container for use. The mixture is made before opening the container and thus can be carried out in perfectly aseptic conditions.

The object of the invention will be better understood by the following description of an embodiment given by way of example.

Figure 1:
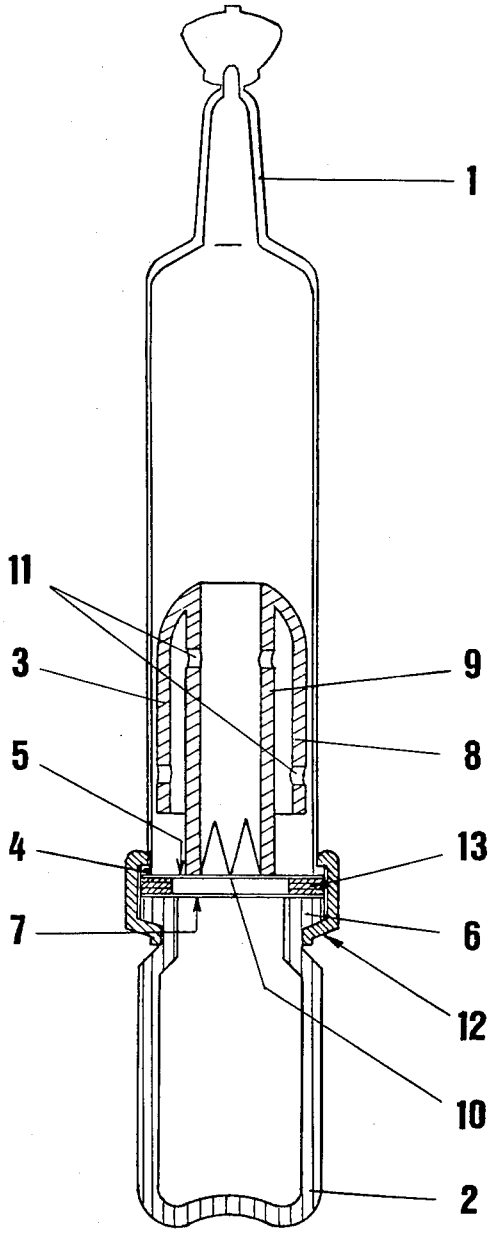
FIG. 1 shows a vertical section through a container with two compartments and two caps, the container being filled and ready for use.

The container shown in FIG. 1 is essentially constituted by a flexible tube 1 of polypropylene or equivalent material and by a glass bottle 2. The flexible tube 1 contains an element made of rigid plastic, termed a plunger 3. The flexible tube 1 is of the type having a tear-off top, as described in French Pat. No. 1,181,592; it is provided at its base with a flange 4 which enables the tube 1 after filling to be sealed by a thin cap 5 made of an aluminum-plastic complex.

The bottle 2 has a neck with a rim 6 of the same outside diameter as the flange 4. This bottle 2 is sealed after filling by a thin cap 7.

The rigid plunger 3 is constituted by a cylindrical skirt 8 of an outside diameter very slightly less than the diameter of the flexible tube 1 so as to be able to slide easily inside the flexible tube 1. The upper part of the pusher is of ogival shape becoming narrower towards the top. This plunger 3 is also provided with a central tube 9 ending in the lower part with a series of sharp teeth 10. Apertures 11 facilitate the circulation of the product through the pusher and avoid the presence of any dead zone.

The tube 1 and the bottle 2 are assembled by means of a tight crimping ring 12. A rubber washer 13 facilitates this assembly avoiding the deterioration of the caps 5 and 7.

The use of the container to which the invention relates is as follows:

The plunger 3 is introduced into the tube 1. After sterilization of the tube 1 and the plunger 3, the tube 1 is filled with the first powder-form or preferably liquid component, then sealed in aseptic conditions by the cap 5. The bottle 2 is filled with the second component of the solution then also sealed in aseptic conditions by the cap 7.

The tube 1 and the bottle 2 are assembled, the washer 13 being interposed between them, then joined by crimping the aluminum ring 12 as shown in FIG. 1. These operations can also be carried out in conditions of perfect asepsia.

Figure 2:
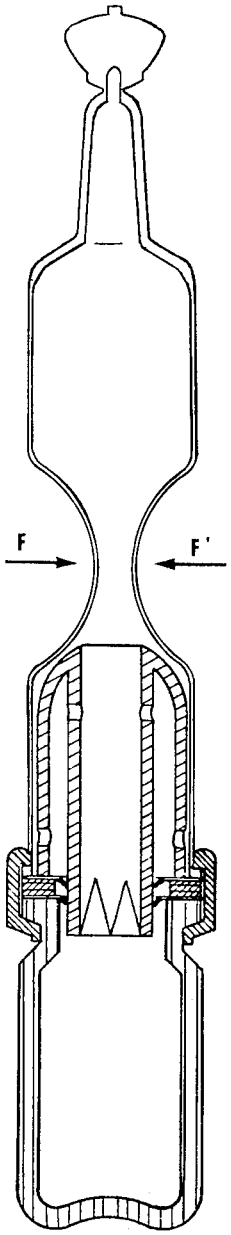
FIG. 2 shows a section of the same container after the two components have been placed in communication but before the opening of the container for the use of the mixture.

In order to use the solution or mixture of the two components, firstly the two compartments 1 and 2 are placed in communication. To achieve this, as shown in FIG. 2, the head of the pusher 3 is pressed between two fingers according to FF' through the flexible tube 1 and the pusher 3 is thereby displaced downwardly. The teeth 10 perforate successively the two caps 5 and 7. The two compartments are thus placed in communication without any external intervention. It only remains necessary to shake the assembly to obtain a good mixture. The operation can be effected up to this point in conditions of perfect asepsia. It then suffices to tear off the head of the flexible tube to use the product.

Figure 3:
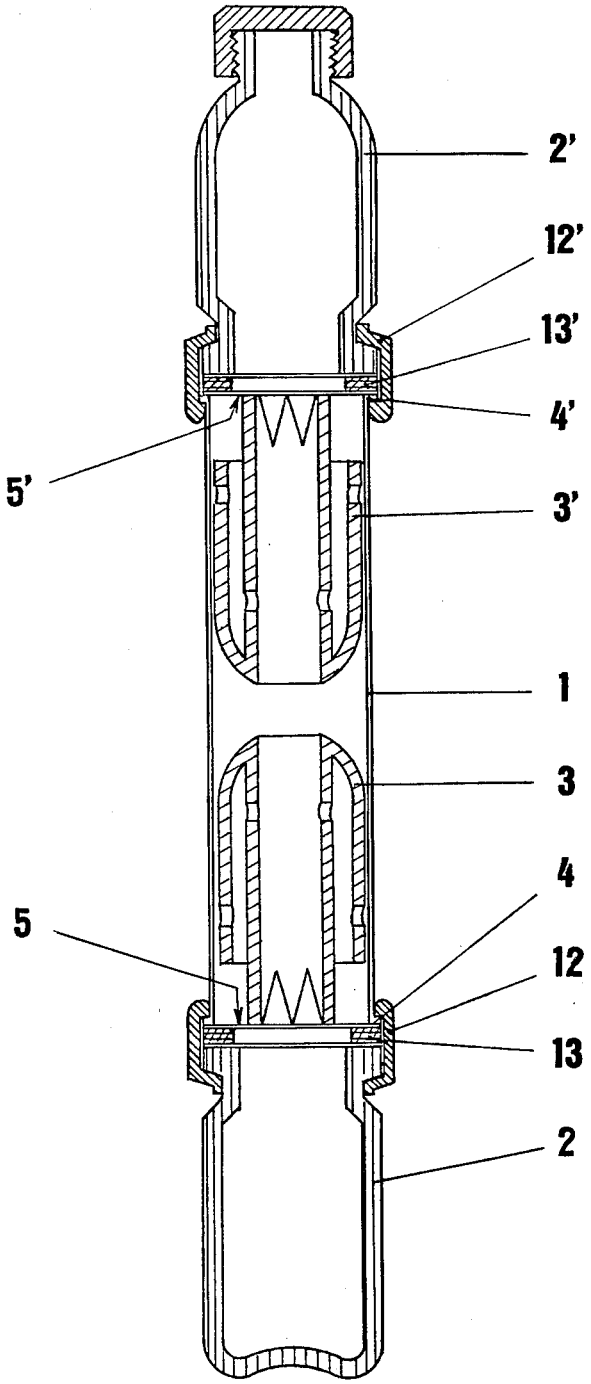
FIG. 3 shows a similar container with three compartments.

Three-compartment containers have also been produced according to the same principle as shown in FIG. 3. In this case a flexible tube 1 is used being provided at its extremities with two symmetrical flanges 4 and 4'. This flexible tube contains two plungers 3 and 3' arranged symmetrically. It is sealed by two symmetrical caps 5 and 5'.

This flexible tube is assembled at the two extremities by crimping two rings 12 and 12' onto two other compartments 2 and 2' which are preferably rigid, while two rubber washers 13 and 13' are interposed between the respective caps. The upper rigid tube 2' is in the example shown as sealed by a stopper screwed onto the head of the container. The product can thus be used on several occasions, obviously with less good conditions of asepsia in subsequent use than in the first instance.

Figure 4:
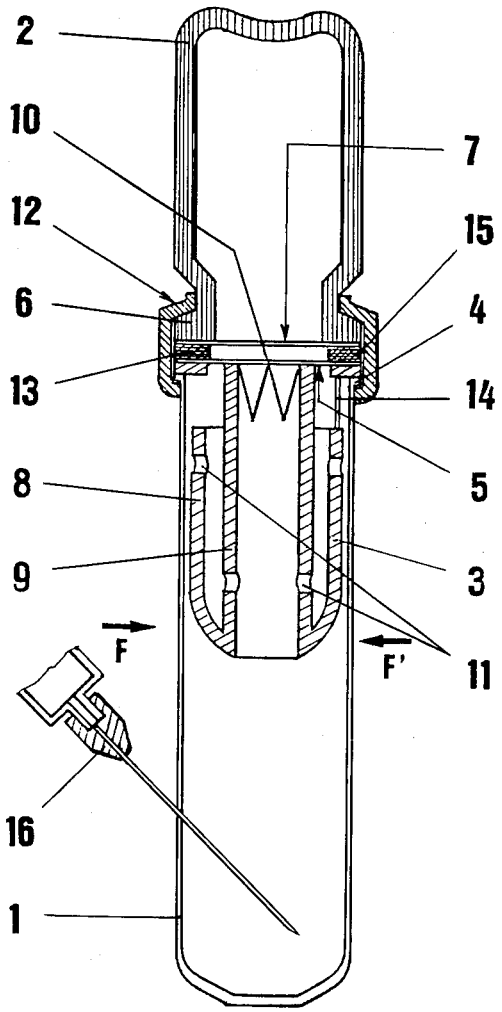
FIG. 4 shows a variant in which the plunger is immobilized before use by a flexible tab.
Figure 5:
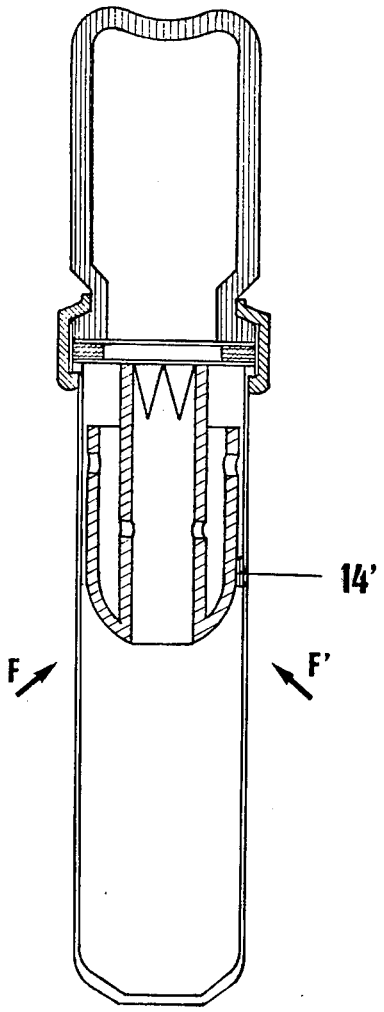
FIG. 5 shows another modification.

The containers shown in FIGS. 4 and 5 are used in a similar manner to that shown in FIGS. 1 and 2.

The plunger 3 is integral with a thin flexible tab 14 which links it to a washer 15. The tab 14 immobilizes the plunger 3 loosely in the tube 1 in a position near to its perforation position as can be seen from the drawing.

At the moment of use, a lateral pressure (FF') is exerted on the flexible tube 1. The tab 14 is deflected and the plunger perforates the two caps 5 and 7 placing the two compartments 1 and 2 in communication. It is then sufficient to shake the assembly to obtain the desired extemporaneous solution.

As shown in FIG. 5, the upper part of the plunger 3 can also be linked to the flexible wall of the tube 1 by a thin flexible tab 14'. In this case, under the effect of a squeezing force FF' oriented obliquely towards the glass bottle 2, the flexible tube 1 is deformed and the plunger 3 perforates the two caps 5 and 7 while remaining integral with the wall of the flexible tube 1.

This loose immobilization of the plunger 3 in the flexible tube permits the easy use of a syringe 16 sucking in the product through the flexible wall as shown in FIG. 4, without the risk of striking the pusher. For this use, it is evident that the containers must be reversed, with the flexible tube 1 at the bottom, as shown in FIGS. 4 and 5.

I claim:

1. A package for the separate storage and mixing of different materials, said package comprising at least two independently formed compartments, each compartment receiving one of said materials therein and being separately sealed by a cap independently of the remaining compartments for an individual handling and processing of each compartment, said package further comprising an assembly of said compartments with the caps thereof in closely spaced direct alignment with each other, separate means both sealing said compartments to each other between the aligned caps and sealing the space between the aligned caps, and pusher means completely received and sealed within at least one compartment, said pusher means having a piercing end thereon for selective projection through the closely spaced aligned caps for a severing of said caps and a communication of the interiors of the compartments through the sealed space between the caps without affecting the means sealing said compartments to each other and without exposure of the pusher means outside of a sealed environment.

2. A package as defined in claim 1, wherein the compartment containing the pusher means is formed of a flexible material enabling an external manipulation of the pusher means, without access to the interior of this compartment, by a flexing of the material of the compartment.

3. A package as defined in claim 2, wherein the separate means sealing said compartments to each other comprises seals positioned between the compartments and about the aligned caps, and a crimping ring encircling the seals and engaged with the compartments.

4. A package as defined in claim 2, wherein the interiors of said compartments and the portion of the package between the aligned caps are sterile.

5. A package as defined in claim 2, wherein the flexible material compartment is cylindrical inwardly of the associated cap, said pusher means comprising a rigid hollow tubular member aligned within the cylindrical compartment and having perforating means on one end thereof directed toward the aligned caps, said pusher means further including a cylindrical skirt fixed to the tubular member in outwardly spaced surrounding relation thereto, said skirt being of a diameter slightly less than that of the cylindrical compartment.

6. A package as defined in claim 5, including a tab engaged with said pusher means for a selective immobilization thereof, said tab flexing upon the application of pressure to said pusher means so as to allow for movement of the pusher means.

7. A package as defined in claim 1, wherein three compartments are provided, the assembly of compartments comprising a central compartment having opposed ends, each sealed by a cap independently of the remaining compartments, the remaining two compartments having the caps thereof respectively in closely spaced alignemnt with the two caps of the central compartment to provide two sets of aligned caps, said pusher means being sealed within the central compartment and having opposed piercing ends thereon selectively projectible through both sets of caps.

8. A package as defined in claim 7 wherein said central compartment is of a flexible material enabling an external manipulation of the pusher means without requiring entry into the central compartment.

* * * * *